US010276316B2

(12) United States Patent
Turner et al.

(10) Patent No.: US 10,276,316 B2
(45) Date of Patent: Apr. 30, 2019

(54) CONTROL KNOB ASSEMBLY FOR A COOKTOP APPLIANCE

(71) Applicant: Haier US Appliance Solutions, Inc., Wilmington, DE (US)

(72) Inventors: Darren Allen Turner, Louisville, KY (US); Vedamoorthy Nellaiappan, Lafayette, GA (US); Kenneth Willard Johnson, Ringgold, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 57 days.

(21) Appl. No.: 15/672,348

(22) Filed: Aug. 9, 2017

(65) Prior Publication Data

US 2019/0051468 A1 Feb. 14, 2019

(51) Int. Cl.

| | |
|---|---|
| ***H01H 3/08*** | (2006.01) |
| ***G05G 1/12*** | (2006.01) |
| *F24C 3/12* | (2006.01) |
| *F24C 3/10* | (2006.01) |

(52) U.S. Cl.

CPC ..... *H01H 3/08* (2013.01); *G05G 1/12* (2013.01); *F24C 3/10* (2013.01); *F24C 3/124* (2013.01)

(58) Field of Classification Search

CPC .. F24C 3/10; F24C 3/122; F24C 3/124; F24C 7/062; F24C 7/082; G05G 1/105; G05G 1/12; F21W 2131/307; H01H 3/08

See application file for complete search history.

(56) References Cited

U.S. PATENT DOCUMENTS

| | | | | |
|---|---|---|---|---|
| 4,947,011 | A | 8/1990 | Muram | |
| 6,213,614 | B1 | 4/2001 | Gjerde | |
| 6,571,727 | B2 | 6/2003 | Gjerde | |
| 6,876,313 | B2 * | 4/2005 | Hsiung | G05G 1/105 200/310 |
| 2006/0025874 | A1 | 2/2006 | Huffington et al. | |
| 2017/0307206 | A1 * | 10/2017 | Yantis | G02B 6/0001 |
| 2018/0010932 | A1 * | 1/2018 | Bach | G01D 5/3473 |
| 2018/0301301 | A1 * | 10/2018 | Bach | H01H 25/002 |

FOREIGN PATENT DOCUMENTS

| | | | |
|---|---|---|---|
| EP | 0611151 | B1 | 8/1994 |
| WO | WO1994001881 | A1 | 1/1994 |

* cited by examiner

*Primary Examiner* — Julie A Bannan

(74) *Attorney, Agent, or Firm* — Dority & Manning, P.A.

(57) ABSTRACT

A control knob assembly for a cooktop appliance provides a readily visible indicator of the power level of a heating element. The control knob assembly includes a control knob that is rotatably mounted to a center housing and defines an arcuate light display and contact features that extend toward the center housing. A stationary shutter that defines an arcuate aperture is fixedly positioned between a light source and the control knob for at least partially allowing light from the light source. A mobile shutter is positioned between the stationary shutter and the control knob and includes an axial paddle extending along the axial direction for engaging the contact features as the control knob is rotated, thereby rotating a radial shutter for blocking a portion of the arcuate aperture.

20 Claims, 7 Drawing Sheets

CONTROL KNOB ASSEMBLY FOR A COOKTOP APPLIANCE

FIELD OF THE INVENTION

The present subject matter relates generally to cooktops appliances and more particularly to a system for illuminating control knobs on cooktop appliances.

BACKGROUND OF THE INVENTION

Control knobs are commonly used on a variety of commercial and residential appliances to control an operating condition of the appliance. Control knobs are particularly common on cooking appliances, such as stoves or cooktops. Various shapes and sizes can be used depending upon, e.g., the intended application, aesthetics, and other factors.

For example, cooktops traditionally have at least one heating element positioned at a cooktop surface for use in heating or cooking an object, such as a cooking utensil and its contents. The at least one heating element may heat a cooking utensil directly through induction heating or may use another heat source such as electrically resistant coils or gas burners. Control knobs are typically used to adjust the power level of the heating element—and thus the amount of heat delivered by the heating element. In other appliances, e.g., ovens, washing machines, clothes dryers, etc., control knobs are often used to select an operating mode of the appliance, such as "bake" or "broil" for ovens, "cotton" or "permanent press" for clothes dryers, etc.

Often the position of the control knob, and thus the operating mode or power level setting it controls, is not readily visible to a user of the appliance from a distance, for example, across the kitchen from the dining room. To provide a user with easily visible feedback regarding the setting of the power control and thus the power being supplied to the heating element, cooktops with mechanical knobs generally include a display for communicating a status of the heating element. For example, displays may typically include a fixed light source illuminating one or more translucent portions defined by the control knob. However, because light may bleed undesirably to adjacent indicators, it is often difficult for a consumer to precisely ascertain the power level.

Accordingly, a cooktop appliance having a control knob with improved knob illumination is desirable. More particularly, a control knob assembly that can accurately illuminate a portion of the control knob to provide an easily visible indication of the angular position of the control knob and the status of the heating element would be particularly beneficial.

BRIEF DESCRIPTION OF THE INVENTION

The present disclosure relates generally to a control knob assembly for a cooktop appliance that provides a readily visible indicator of the power level of a heating element. The control knob assembly includes a control knob that is rotatably mounted to a center housing and defines an arcuate light display and contact features that extend toward the center housing. A stationary shutter that defines an arcuate aperture is fixedly positioned between a light source and the control knob for at least partially blocking light from the light source. A mobile shutter is positioned between the stationary shutter and the control knob and includes an axial paddle extending along the axial direction for engaging the contact features as the control knob is rotated, thereby rotating a radial shutter for blocking a portion of the arcuate aperture. Additional aspects and advantages of the invention will be set forth in part in the following description, or may be apparent from the description, or may be learned through practice of the invention.

In one exemplary embodiment, a control knob assembly defining an axial direction, a radial direction, and a circumferential direction is provided. The control knob assembly includes a light source and a control knob being rotatable about the axial direction, the control knob including one or more contact features extending along the axial direction toward the light source and an arcuate light display. A stationary shutter is fixedly positioned between the light source and the control knob, the stationary shutter defining an arcuate aperture extending along the circumferential direction to at least partially allow light from the light source to pass toward the arcuate light display. A mobile shutter is positioned between the light source and the control knob and being rotatable about the axial direction, the mobile shutter defining a radial shutter extending along the radial direction and an axial paddle extending along the axial direction for engaging the one or more contact features as the control knob is rotated.

In another exemplary embodiment, a cooktop appliance is provided. The cooktop appliance includes a cooking surface including a heating source, a control panel defining an aperture, and a control knob assembly for regulating a power level of the heating source, the control knob assembly defining an axial direction, a radial direction, and a circumferential direction. The control knob assembly includes a light source and a control knob being rotatable about the axial direction, the control knob including one or more contact features extending along the axial direction toward the light source and an arcuate light display. A stationary shutter is fixedly positioned between the light source and the control knob, the stationary shutter defining an arcuate aperture extending along the circumferential direction to at least partially allow light from the light source to pass toward the arcuate light display. A mobile shutter is positioned between the stationary shutter and the control knob and being rotatable about the axial direction, the mobile shutter defining a radial shutter extending along the radial direction and an axial paddle extending along the axial direction for engaging the one or more contact features as the control knob is rotated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
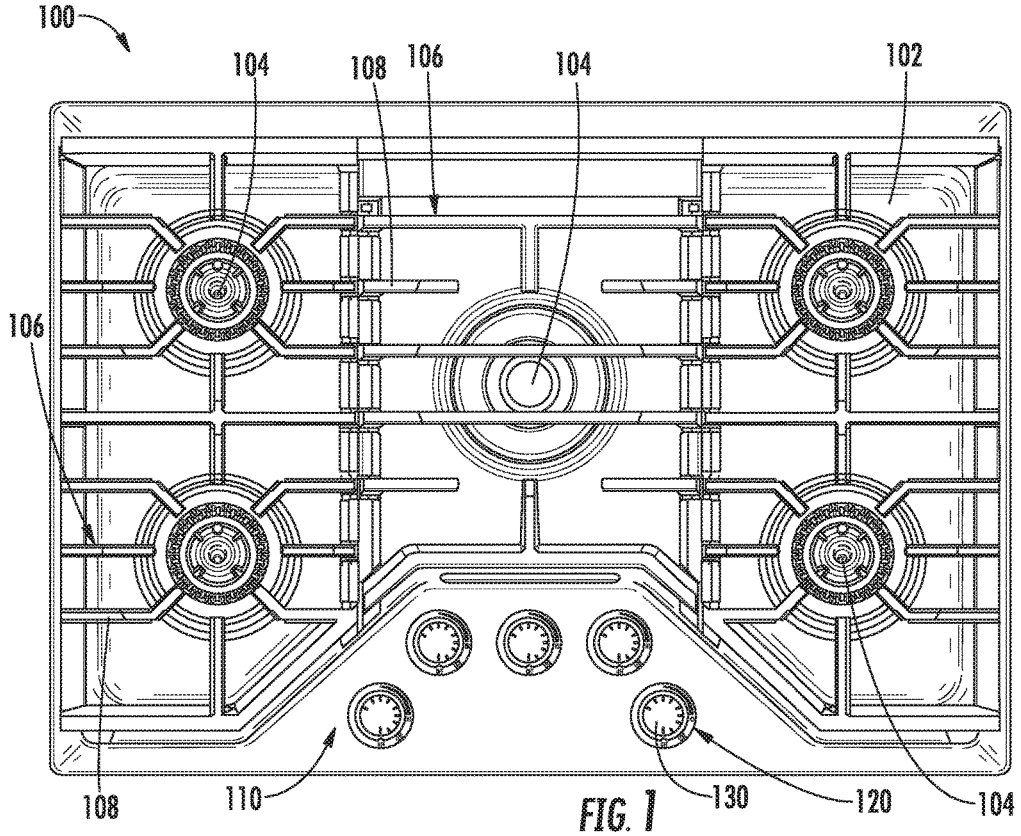
FIG. 1 provides a top view of a cooktop appliance according to an exemplary embodiment of the present subject matter.
Figure 2:
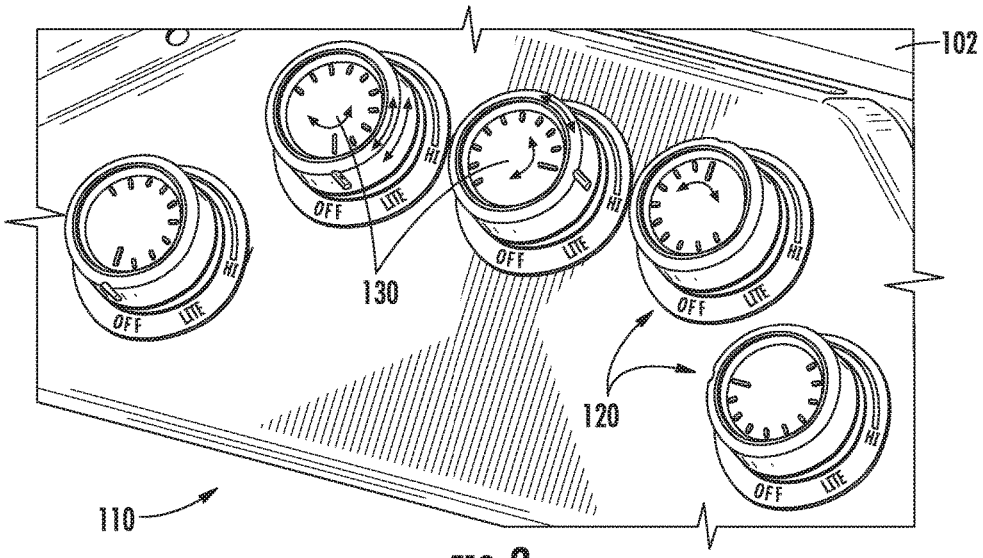
FIG. 2 provides a perspective view of a control panel of the exemplary cooktop appliance of FIG. 1.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a control knob assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary control knob assemblies described below may be used on other types of cooking appliances, such as ranges or oven appliances, or on dishwashing appliances, washing machines, clothes dryers, or any other consumer or commercial appliance that operates at least in part based on user input through a control knob. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated embodiment, cooktop appliance 100 is a gas cooktop and heating elements 104 are gas burners. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 106 configured to support a cooking utensil, such as a pot, pan, etc. In general, grates 106 include a plurality of elongated members 108, e.g., formed of cast metal, such as cast iron. The cooking utensil may be placed on the elongated members 108 of each grate 106 such that the cooking utensil rests on an upper surface of elongated members 108 during the cooking process. Heating elements 104 are positioned underneath the various grates 106 such that heating elements 104 provide thermal energy to cooking utensils above top panel 102 by combustion of fuel below the cooking utensils.

Although heating elements 104 are illustrated herein as gas burners, it should be appreciated that according to various alternative embodiments, heating elements 104 may employ any suitable method for heating or cooking an object, such as a cooking utensil and its contents. For example, cooktop appliance 100 may be a gas cooktop, a radiant smooth top cooktop, an electric coil cooktop, an induction cooktop, etc. Thus, according to alternative embodiments, heating elements 104 use another heat transfer method, such as electric coils or induction elements, to heat the cooking utensil. Moreover, the configuration of cooktop appliance 100 and top panel 102 may vary according to the type of cooktop and heating elements. For example, in smooth top (e.g., glass) and induction cooktop applications, top panel 102 may directly support the cooking utensils, such that no grate 106 is needed. In this regard, top panel 102 may be a constructed of a ceramic glass for supporting the cooking utensil and heating element 104 may be positioned within or below top panel 102. By contrast, in an electric coil cooktop, the heating element 104 (e.g., the electrical coil) directly supports the cooking utensil. Other configurations are possible and within the scope of the present subject matter.

According to the illustrated exemplary embodiment, a user interface panel or control panel 110 is located within convenient reach of a user of cooktop appliance 100. For this exemplary embodiment, control panel 110 includes control knob assemblies 120 that are each associated with one of heating elements 104. Control knob assemblies 120 allow the user to activate each heating element 104 and regulate the amount of heat input each heating element 104 provides to a cooking utensil located thereon, as described in more detail below. Control panel 110 may also be provided with one or more graphical display devices, such as a digital or analog display device designed to provide operational feedback to a user.

According to the illustrated embodiment, control knob assemblies 120 are located within control panel 110 of cooktop appliance 100. However, it should be appreciated that this location is used only for the purpose of explanation, and that other locations and configurations of control panel 110 and control knob assemblies 120 are possible and within the scope of the present subject matter. Indeed, according to alternative embodiments, control knob assemblies 120 may instead be located directly on top panel 102 or elsewhere on cooktop appliance 100, e.g., on a backsplash, front bezel, or any other suitable surface of cooktop appliance 100.

Referring now generally to FIGS. 2 through 10, a control knob assembly 120 that may be used with cooktop appliance 100 will be described in more detail. Although the discussion below refers to an exemplary control knob assembly 120, it should be appreciated that the features and configurations described may be used for other knob assemblies in other cooking appliances or consumer appliances as well. For example, control knob assembly 120 may be positioned elsewhere within cooktop appliance 100, may have different components or configurations, and use alternative mechanisms for illuminating the knob or the region surrounding the knob. Other variations and modifications of the exemplary embodiment described below are possible, and such variations are contemplated as within the scope of the present subject matter.

Figure 3:
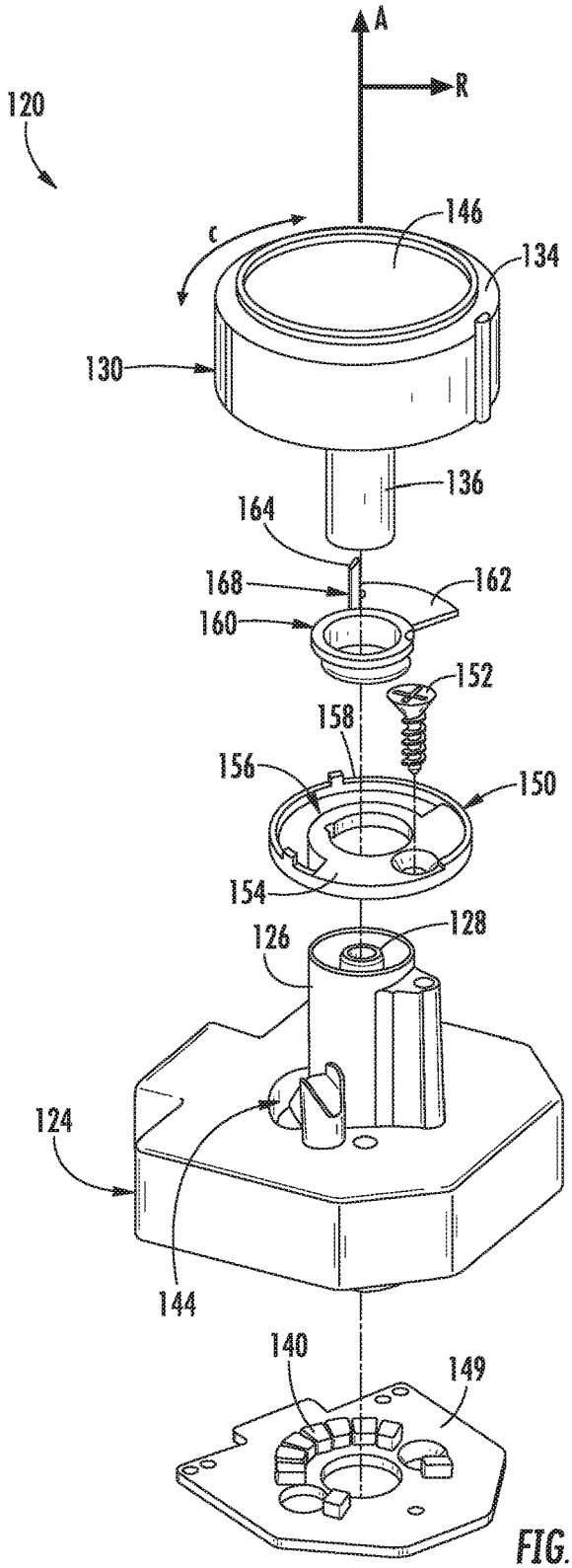
FIG. 3 provides an exploded perspective view of a control knob assembly that may be used with the exemplary cooktop appliance of FIG. 1 according to an exemplary embodiment of the present subject matter.

Referring now to FIG. 3, an exploded view of control knob assembly 120 will be described. As shown, control knob assembly 120 generally defines an axial direction A, a radial direction R, and a circumferential direction C. In this regard, for example, control knob assembly 120 generally passes through an aperture 122 (see FIG. 4) defined in control panel 110 along the axial direction A, which is substantially normal to control panel 110. However, according to alternative embodiments, aperture may be any suitable size or shape and may be positioned in any suitable surface of cooktop appliance 100.

As illustrated in FIG. 3, control knob assembly 120 includes a center housing 124 that is positioned below user interface panel 110. Center housing 124 defines a central boss 126 that passes through aperture 122 and through which a control shaft 128 extends. According to an exemplary embodiment, control knob assembly 120 further includes a control knob 130 that is manipulated by a user for regulating the amount of heat delivered by a corresponding heating element 104 on top panel 102. In this regard, control knob 130 is generally rotatable about the axial direction A for controlling the power level of a respective heating element 104.

As used herein, control knob 130 may refer to any configuration of rotary dial, and not just one having a circular base, as shown in FIG. 1. For example, the present disclosure contemplates exemplary embodiments wherein knobs 130 have a rectangular base, an oval base, or any other shape having one or more curved lines, straight lines, or both. Furthermore, although control knob 130 is illustrated as controlling the power level of heating element 104 of cooktop appliance 100, one skilled in the art will appreciate that aspects of the present disclosure may be used to control alternative operating conditions on other appliances. For example, according to alternative embodiments, control knob 130 may be used to regulate a wash time on a washing machine or to select a wash cycle on a dishwasher.

Figure 5:
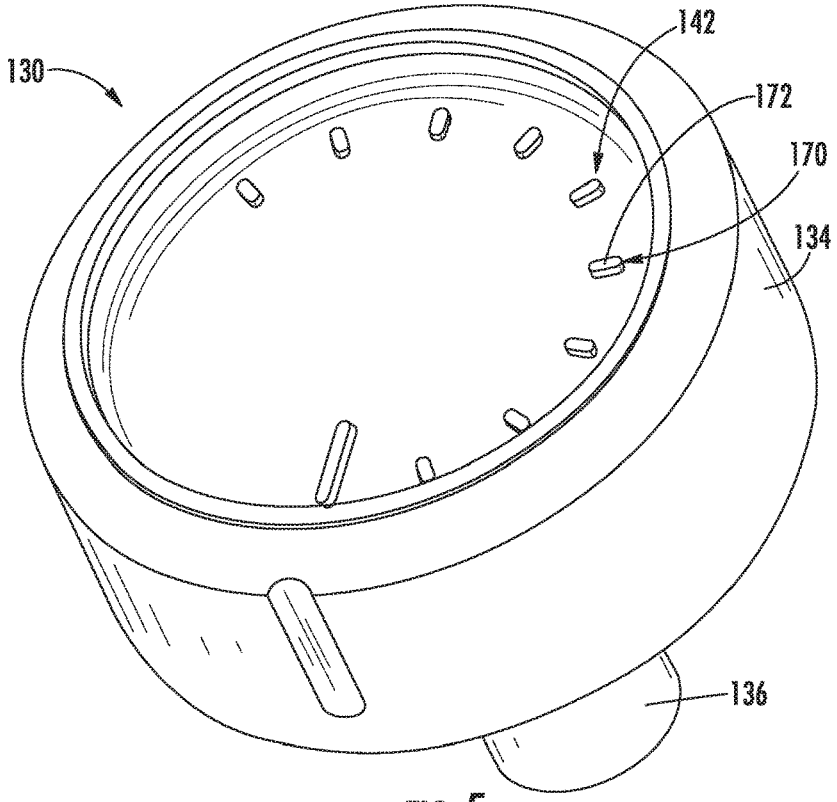
FIG. 5 provides a top perspective view of a control knob of the exemplary control knob assembly of FIG. 3.
Figure 6:
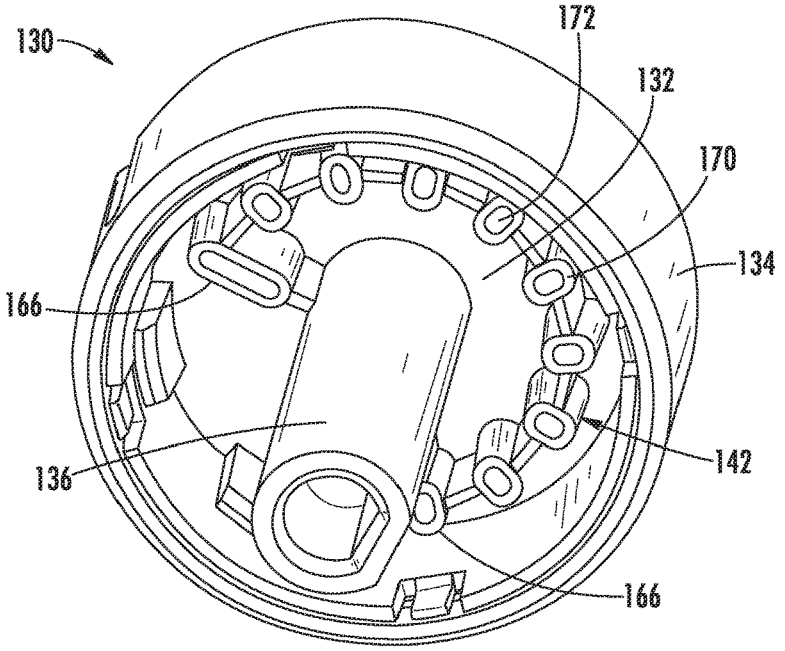
FIG. 6 provides a bottom perspective view of the exemplary control knob of FIG. 5.
Figure 7:
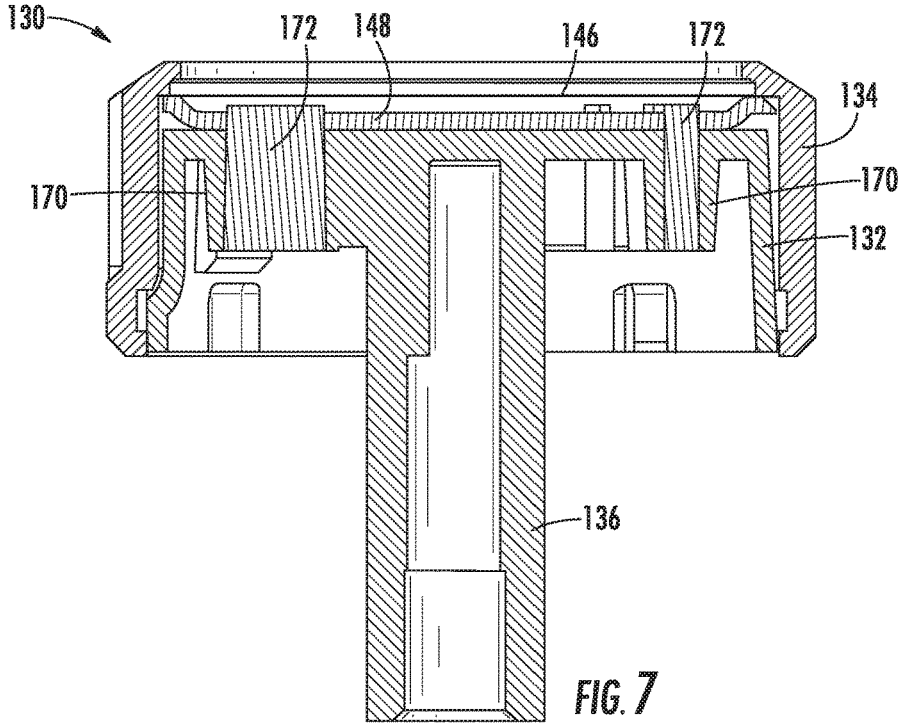
FIG. 7 provides a cross sectional view of the exemplary control knob of FIG. 5.
Figure 8:
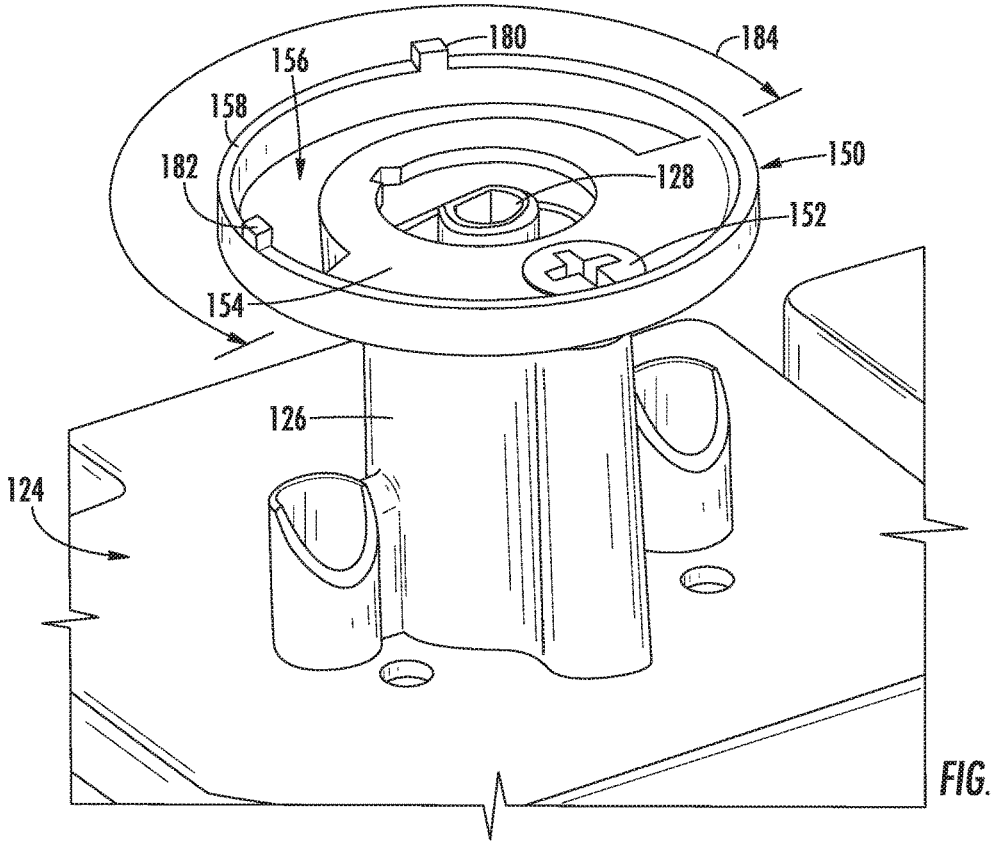
FIG. 8 provides a perspective view of the exemplary control knob assembly of FIG. 3 with several components removed to reveal a stationary shutter according to an exemplary embodiment of the present subject matter.
Figure 9:
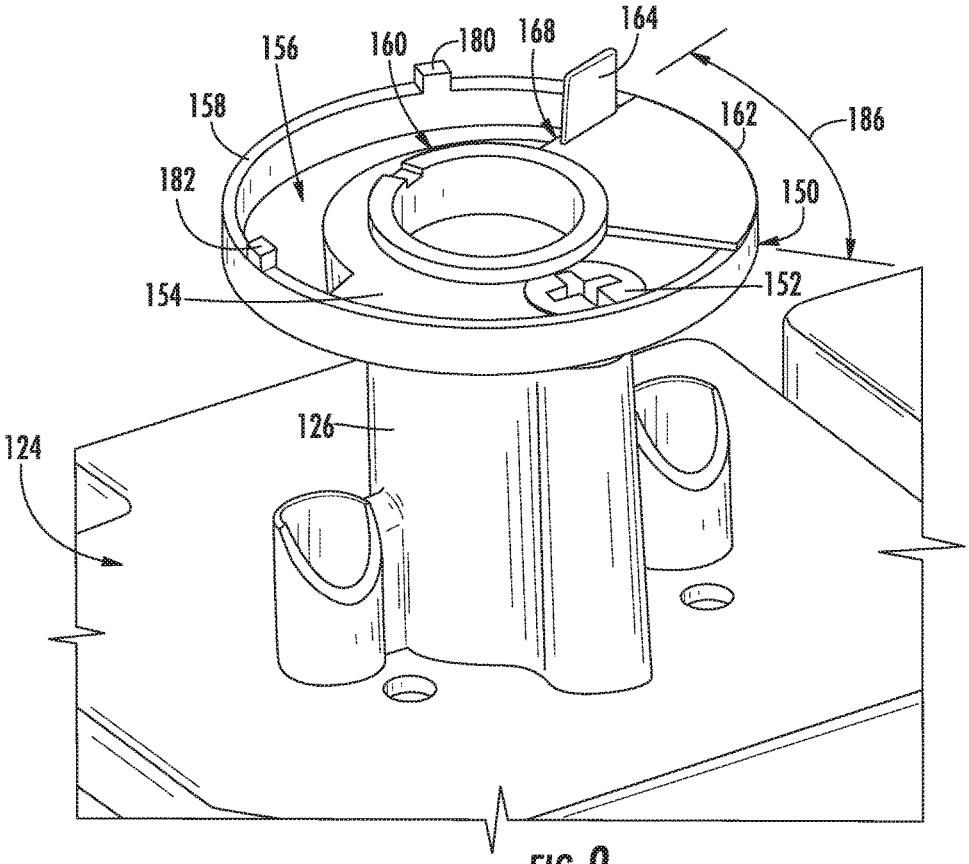
FIG. 9 provides a perspective view of the exemplary control knob assembly of FIG. 3 with the control knob removed to reveal the stationary shutter and a mobile shutter according to an exemplary embodiment of the present subject matter.

Referring now specifically to FIGS. 5 through 7, control knob 130 will be described in more detail. As illustrated, control knob 130 includes an inner support piece 132 which is configured to interface with control shaft 128 and an outer knob 134 positioned around the inner support piece 132. In general, inner support piece 132 includes various functional features of control knob 130 while outer knob 134 is a decorative control piece that may be manipulated by the user. According to the illustrated embodiment, inner support piece 132 and outer knob 134 are joined using a snap-fit mechanism. However, any suitable method for joining inner support piece 132 and outer knob 134 may be used according to alternative embodiments. For example, according to other exemplary embodiments, inner support piece 132 and outer knob 134 may be joined using an adhesive or integrally formed as a single component. It should be appreciated that according to alternative embodiments, control knob 130 could instead be a one-piece design.

As illustrated, control knob 130 includes a receiving boss 136 that extends along the axial direction A through aperture 122. More specifically, inner support piece 132 defines receiving boss 136 which is configured to receive control shaft 128 such that control knob 130 is operatively coupled with control shaft 128. In this regard, for example, receiving boss 136 may have a D-shaped cross section that is configured to receive control shaft 128, which has a corresponding D-shaped profile. In this manner, control shaft 128 is securely received by control knob 130 and rotates precisely with control knob 130 with little or no lag. According to the illustrated embodiment, control knob 130 is removably attached to control shaft 128, e.g., for easy cleaning. However, according to alternative embodiments, control shaft 128 may be integrally formed with control knob 130. It should be noted that while the D-shaped control shaft 128 profile is illustrated in this discussion, other shapes may be used so long as they rotationally link control knob 130 and control shaft 128.

Control shaft 128 may be further configured for regulating a flow of fuel to the gas burner or heating element 104 using a gas control valve (not shown). In this regard, rotating control knob 130 a certain amount in the circumferential direction C rotates control shaft 128 the same amount in the circumferential direction C, thereby controlling the gas control valve. By contrast, if heating elements 104 are electric or induction heating elements, control shaft 128 could instead be coupled to an electronic regulator, e.g., an infinite switch that controls the amount of electrical power delivered to heating element 104.

Figure 4:
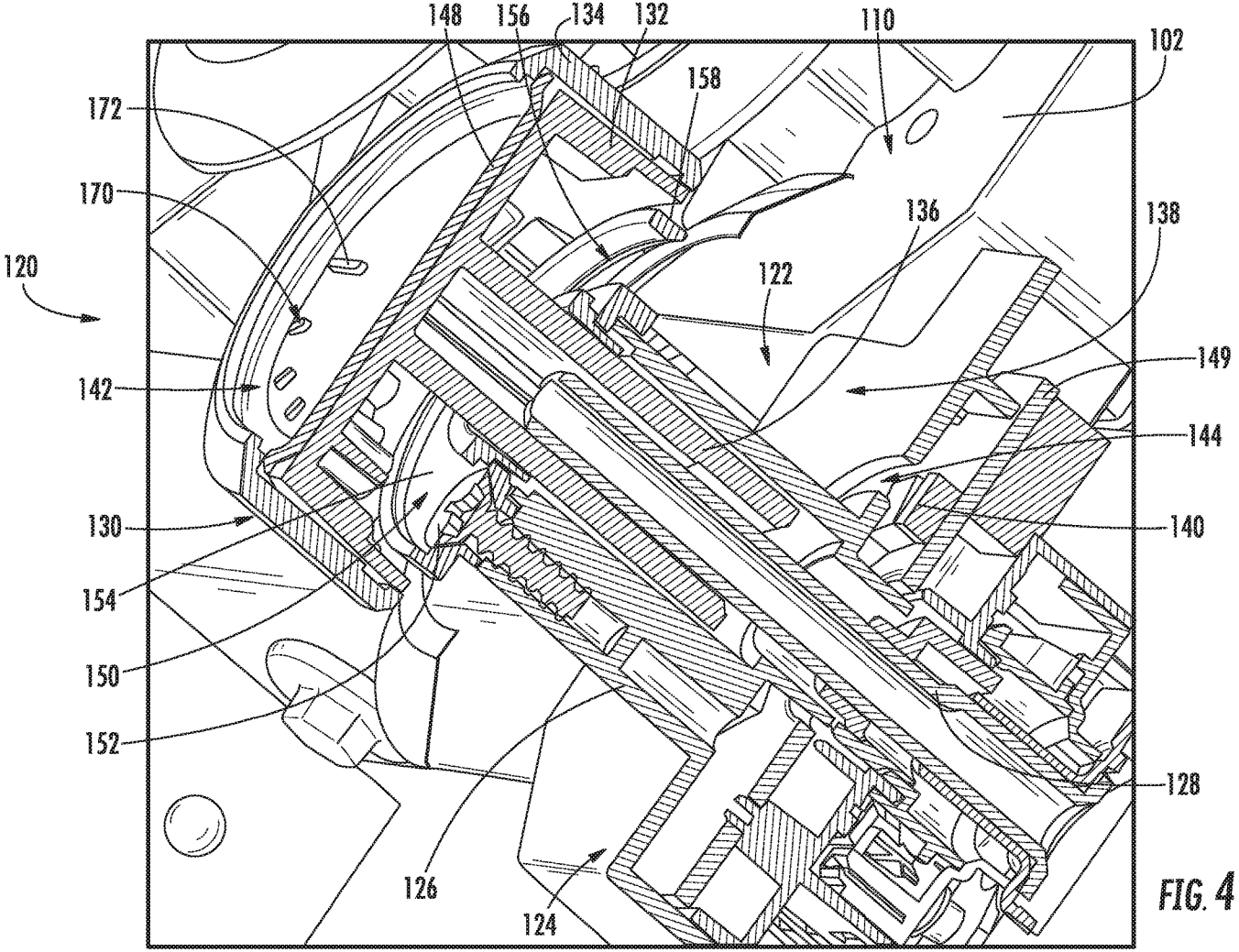
FIG. 4 provides a cross sectional view of the exemplary control knob assembly of FIG. 3.

Certain types of appliances, such as gas cooktops, often require the ingestion of air into the appliances for the purposes of gas burner combustion. By contrast, often an electric appliance requires the ingestion of air for the cooling of electrical components within the chassis of the appliance. In such appliances, a practical inlet of this cooling or combustion air is through a gap between the knob stem (or gas valve shaft) and the opening in the control panel. Therefore, as best illustrated in FIG. 4, control knob assembly 120 is positioned within aperture 122 of control panel 110 such that an air gap 138 is defined between control knob assembly 120 and top panel 102 of cooktop appliance 100. In this manner, air may flow through aperture 122 to support combustion of heating elements 104 and provide cooling to various components of cooktop appliance 100. However, it should be appreciated that air gap 138 is not necessary to the operation of control knob assembly 120.

In order to provide a visual indication of the power level of heating element 104 on control knob 130, control knob 130 includes a display which is selectively illuminated according to the angular position of control knob 130 and the corresponding power level. More specifically, control knob assembly 120 includes a light source 140 that directs light toward control knob 130 which defines an arcuate light display 142. More specifically, light source 140 is mounted to center housing 124, e.g., below center housing 124 along the axial direction A (i.e., opposite control knob 130). Center housing 124 further defines a hub aperture 144 through which light from light source 140 may be directed toward control knob 130. However, it should be appreciated that according to alternative embodiments, light source 140 may be positioned on top of center housing 124 or at any other suitable location within cooktop appliance 100 for directing light toward control knob 130. For example, according to certain exemplary embodiments, central housing 124 may be omitted altogether and light source 140 may be mounted directly to central boss 126 or any other stationary part of control knob assembly 120.

Control knob 130 may further include a transparent disk 146 mounted between inner support piece 132 and outer knob 134. For example, according to the illustrated embodiment, transparent disk 146 is a circular glass plate positioned within control knob 130 to provide an aesthetic, transparent, and easy to clean surface visible to the user of cooktop appliance 100. In addition, control knob 130 includes an appearance piece 148 positioned between inner support piece 132 and transparent disk 146. Appearance piece 148 may be, for example, a polished stainless steel plate that hides certain portions of inner support piece 132 from the user's view. In addition, appearance piece 148 may define a plurality of apertures, e.g., to transmit light from light source 140 and provide a power level indicator to a user.

Although control knob 130 is illustrated as having a transparent disk 146 and appearance piece 148, it should be appreciated that the same visual effect may be achieved using alternative constructions. For example, according to alternative embodiments, transparent disk 146 may be constructed of transparent (clear or dark-tinted) glass or plastic material. An opaque backing material or masking layer may be printed on a bottom surface of transparent disk 146 to define various apertures or openings, e.g., translucent portions which allow light to travel through the transparent disk 146 and be visible to a user of cooktop appliance 100. Using such constructions, light source 140 may be used to illuminate control knob 130 and provide a highly visible indication to the user of the particular position of control knob 130 and the temperature of heating element 104.

As best shown in FIGS. 3 and 4, light source 140 may be any suitable light source or combination of light sources. For example, according to the illustrated embodiment, light source 140 may include a plurality of light emitting diodes (LEDs) distributed in a circular pattern on a printed circuit board or control board 149. In addition, LEDs may be spaced apart at a fixed radius similar to the radius of the arcuate light display 142 of control knob 130. In this manner, light from light source 140 may be directed straight through hub aperture 144 toward arcuate light display 142. These light sources 140 may be configured for illuminating as a single color, e.g., red, green, white, etc., or may be capable of illuminating in more than one color, e.g., an R-G-B LED. As another example, light source 140 may be another electrical light source, such as one or more traditional light bulbs, e.g., grain of wheat bulbs, etc. It should be obvious to one skilled in the art that other arrangements of LEDs could be used at each light source 140.

Notably, certain conventional control knobs include a plurality of lights which are progressively illuminated as the control knob is turned, but such configurations often require complex and costly positional feedback systems and sensors as well as complex controller algorithms. Alternatively, moving mechanisms within control knob may be used to block or allow a portion of the light from light source 140 to indicate power level, but conventional mechanisms suffer from light bleed onto adjacent portions of the display and fail to define power levels with sharp, distinct light indicators. Therefore, control knob assembly 120 includes a plurality of additional light control features for illuminating arcuate light display 142 of control knob 130 in a desirable manner, as described below.

Referring generally to FIGS. 3 through 9, control knob assembly 120 includes a stationary shutter 150 fixedly positioned between light source 140 and control knob 130. According to the illustrated embodiment, stationary shutter 150 is fixed to center housing 124 using any suitable mechanical fastener 152, such as screws, bolts, rivets, etc. Similarly, glue, bonding, snap-fit mechanisms, interference-fit mechanisms, or any suitable combination thereof be used to join stationary shutter 150 and center housing 124. In addition, according to another embodiment, stationary shutter 150 is formed integrally with the center housing 124, e.g., via an injection molding process.

Stationary shutter 150 generally includes an opaque disk 154 that extends substantially along the radial direction R to block a portion of the light from light source 140. In addition, stationary shutter 150 defines an arcuate aperture 156 extending along the circumferential direction C within opaque disk 154. For example, the arcuate aperture 156 is illustrated as being defined within a rim 158 of stationary shutter 150. However, according to alternative embodiments, opaque disk 154 only forms a partial circle, such as a semi-circle, to block a portion of the light from light source 140. So configured, opaque disk 154 of stationary shutter 150 blocks at least a portion of light from the light source 140 while arcuate aperture 156 allows at least a portion of that light to illuminate arcuate light display 142.

Referring still to FIGS. 3 through 9, control knob assembly 120 further includes a mobile shutter 160 positioned between stationary shutter 150 and control knob 130. Mobile shutter 160 is rotatable about the axial direction A and is configured for engaging control knob 130 when it is rotated toward certain angular positions, as described below. More specifically, mobile shutter 160 defines a radial shutter 162 extending along the radial direction R and an axial paddle 164 extending along the axial direction A. In addition, control knob 130 includes one or more contact features 166 extending along the axial direction A toward center housing 124. According to the illustrated embodiment, axial paddle 164 extends from an edge 168 of radial shutter 162 along the radial direction R and toward control knob 130 along the axial direction A.

In addition, according to the illustrated embodiment, arcuate light display 142 is a plurality of circumferentially spaced light guides 170, which collectively form arcuate light display 142. As used herein, light guide may be used to refer to any structure, such as a pipe, tube, series of walls, etc., which are configured for directing and concentrating light emitted from light source 140. According to one exemplary embodiment, light guides 170 may be comprised of an opaque material and configured with translucent gems 172 (e.g., a transparent material, a translucent material, or both) through which the light from light source 140 is constrained and directed to transparent disk 146. In this manner, each light guide 170 may be configured to receive light from light source 140 and transmit the light along the length of light guide 170 to precisely illuminate transparent disk 146 according to the power level of heating element 104. Thus, a sharp, high-contrast graphical display may communicate the angular position of control knob 130 and the status of heating element 104 to the user.

According to one exemplary embodiment, contact features 166 on control knob 130 contact axial paddle 164 to rotate mobile shutter 160. These contact features may be simple protruding members that extend along the axial direction A. However, according to the illustrated embodiment, a first guide 170 of the plurality of light guides 170 and a last guide of the plurality of light guides 170 extend far enough along the axial direction A to act as contact features 166. In this manner, the first and last light guide 170 cause mobile shutter 160 to rotate as control knob 130 is rotated through specific angular positions, as described below.

In addition, according to an exemplary embodiment, stationary shutter 150 defines additional features for controlling the rotation of mobile shutter 160 and control knob 130. More specifically, stationary shutter 150 defines a first stopper 180 and a second stopper 182 both extending along the axial direction A toward control knob 130 for stopping mobile shutter 160 in a first angular position and a second angular position respectively.

It should be appreciated that the sizes of arcuate light display 142 (e.g., light guides 170), arcuate aperture 156, mobile shutter 160, and the configuration of light source 140 may all affect how light is displayed on transparent disk 146 of control knob 130. For example, according to an exemplary embodiment, arcuate aperture 156 defines a first arc length 184 measured along the circumferential direction C and radial shutter 162 defines a second arc length 186 measured along the circumferential direction C. First arc length 184 and second arc length 186 may be adjusted to control the dispersion of light from light source 140. According to an exemplary embodiment, first arc length 184 is greater than two times the second arc length 186, and according to the illustrated embodiment, first arc length 184 is approximately 180 degrees and second arc length 186 is approximately 60 degrees. Other configurations are possible and within the scope of the present subject matter.

Figure 10:
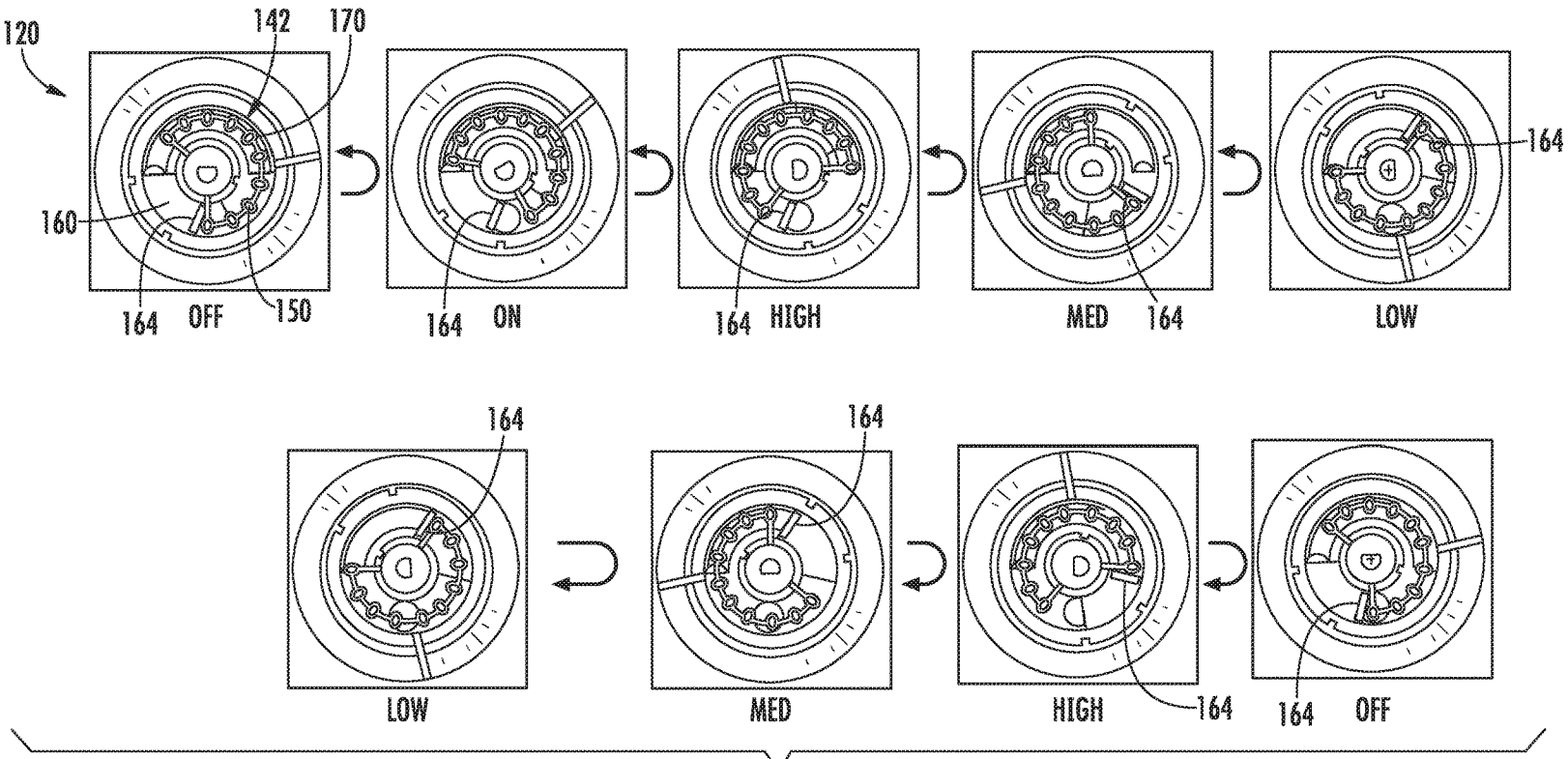
FIG. 10 provides a top schematic view of the exemplary control knob assembly of FIG. 3 as the control knob is rotated counterclockwise and clockwise between various power levels.

Referring now to FIG. 10, the operation of control knob assembly 120 will be briefly described. More specifically, FIG. 10 provides a schematic view of the position of mobile shutter 160 as control knob 130 is progressively rotated from the OFF position counterclockwise to the LOW position and then back clockwise until the OFF position is again reached. As shown, as control knob 130 is rotated from an OFF position, heating element 104 is ignited and operated at the HIGH level. As control knob 160 is rotated, some of the plurality of light guides 170 begin to be hidden as the power level is progressively lowered. When control knob 130 reaches approximately the MEDIUM position, a first guide 170 engages and begins to rotate mobile shutter 160. In this manner, mobile shutter 160 continues to block light from illuminating the light guides that have traveled back into arcuate aperture 156 when control knob 130 is in the LOW position. Then, as control knob 130 is rotated clockwise, mobile shutter 160 is disengaged and remains stationary over a portion of arcuate aperture 156 while the plurality of light guides 170 begin to illuminate as the power level increases. At a certain point, a second guide 170 contacts the opposite side of mobile shutter 160 and begins to rotate it clockwise back into its original position as the plurality of light guides 170 become completely illuminated before control knob 130 reaches the OFF position.

One skilled in the art will appreciate that in addition to the configurations of control knob assembly 120 described herein, alternative configurations of control knob assembly 120 are possible and within the scope of the present subject matter. For example, the size, positioning, and interaction between stationary shutter 150 and mobile shutter 160 may vary, control knob 130 may move mobile shutter 160 in a different manner, and other configurations may be used. It should be appreciated that still other configurations are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A control knob assembly defining an axial direction, a radial direction, and a circumferential direction, the control knob assembly comprising:

a light source;

a control knob being rotatable about the axial direction, the control knob comprising one or more contact features extending along the axial direction toward the light source and an arcuate light display;

a stationary shutter fixedly positioned between the light source and the control knob, the stationary shutter defining an arcuate aperture extending along the circumferential direction to at least partially allow light from the light source to pass toward the arcuate light display; and a mobile shutter positioned between the light source and the control knob and being rotatable about the axial direction, the mobile shutter defining a radial shutter extending along the radial direction and an axial paddle extending along the axial direction for engaging the one or more contact features as the control knob is rotated.

2. The control knob assembly of claim 1, wherein the arcuate aperture defines a first arc length measured along the circumferential direction and the radial shutter defines a second arc length measured along the circumferential direction, the first arc length being greater than two times the second arc length.

3. The control knob assembly of claim 2, wherein the first arc length is approximately 180 degrees and the second arc length is approximately 60 degrees.

4. The control knob assembly of claim 1, wherein the arcuate light display is a plurality of circumferentially spaced light guides.

5. The control knob assembly of claim 4, wherein the axial paddle extends along an edge of the radial shutter along the radial direction and is configured for engaging a first guide of the plurality of light guides and a last guide of the plurality of light guides.

6. The control knob assembly of claim 1, wherein the stationary shutter defines a first stopper extending along the axial direction for stopping the mobile shutter in a first angular position and a second stopper extending along the axial direction for stopping the mobile shutter in a second angular position.

7. The control knob assembly of claim 1, wherein the stationary shutter is formed integrally with a center housing.

8. The control knob assembly of claim 1, wherein the light source is a series of light-emitting diodes (LEDs) mounted to a control board positioned below a center housing along the axial direction, the center housing defining a hub aperture through which light from the LEDs is directed.

9. The control knob assembly of claim 1, wherein the control knob comprises:

an inner support piece defining the arcuate light display;

an outer knob positioned around the inner support piece; and a transparent disk mounted between the inner support piece and the outer knob.

10. The control knob assembly of claim 9, wherein the control knob comprises:

an appearance piece positioned between the inner support piece and the transparent disc.

11. The control knob assembly of claim 1, wherein the control knob assembly comprises:

a stem extending along the axial direction and operably coupling the control knob and a gas control shaft for regulating a flow of gas to a gas burner on a gas cooktop.

12. The control knob assembly of claim 11, wherein the control knob assembly defines an air gap between control knob and a top panel of the gas cooktop.

13. A cooktop appliance, comprising:

a cooking surface including a heating source;

a control panel defining an aperture; and a control knob assembly for regulating a power level of the heating source, the control knob assembly defining an axial direction, a radial direction, and a circumferential direction, the control knob assembly comprising:

a light source;

a control knob being rotatable about the axial direction, the control knob comprising one or more contact features extending along the axial direction toward the light source and an arcuate light display;

a stationary shutter fixedly positioned between the light source and the control knob, the stationary shutter defining an arcuate aperture extending along the circumferential direction to at least partially allow light from the light source to pass toward the arcuate light display; and a mobile shutter positioned between the stationary shutter and the control knob and being rotatable about the axial direction, the mobile shutter defining a radial shutter extending along the radial direction and an axial paddle extending along the axial direction for engaging the one or more contact features as the control knob is rotated.

14. The cooktop appliance of claim 13, wherein the arcuate aperture defines a first arc length measured along the circumferential direction and the radial shutter defines a second arc length measured along the circumferential direction, the first arc length being greater than two times the second arc length.

15. The cooktop appliance of claim 13, wherein the arcuate light display is a plurality of circumferentially spaced light guides.

16. The cooktop appliance of claim 15, wherein the axial paddle extends along an edge of the radial shutter along the radial direction and is configured for engaging a first guide of the plurality of light guides and a last guide of the plurality of light guides.

17. The cooktop appliance of claim 13, wherein the stationary shutter defines a first stopper extending along the axial direction for stopping the mobile shutter in a first angular position and a second stopper extending along the axial direction for stopping the mobile shutter in a second angular position.

18. The cooktop appliance of claim 13, wherein the light source is a series of light-emitting diodes (LEDs) mounted to a control board positioned below a center housing along the axial direction, the center housing defining a hub aperture through which light from the LEDs is directed.

19. The cooktop appliance of claim 13, wherein the control knob comprises:

an inner support piece defining the arcuate light display;

an outer knob positioned around the inner support piece;

a transparent disk mounted between the inner support piece and the outer knob; and an appearance piece positioned between the inner support piece and the transparent disc.

20. The cooktop appliance of claim 13, wherein the control knob assembly comprises:

a stem extending along the axial direction and operably coupling the control knob and a gas control shaft for regulating a flow of gas to a gas burner on a gas cooktop, and wherein the control knob assembly defines an air gap between control knob and a top panel of the gas cooktop.

* * * * *